US005637006A

United States Patent [19]

Almeras

[11] Patent Number: 5,637,006

[45] Date of Patent: Jun. 10, 1997

[54] ELECTROFLUIDIC MIXED CONNECTOR

[75] Inventor: Jean Claude Almeras, Valence, France

[73] Assignee: Sextant Avionique, Meudon la Foret, France

[21] Appl. No.: 337,839

[22] Filed: Nov. 9, 1994

[30] Foreign Application Priority Data

Nov. 19, 1993 [FR] France ..... 93 13974

[51] Int. Cl.[6] ..... H01R 13/53

[52] U.S. Cl. ..... 439/191; 439/747; 439/587

[58] Field of Search ..... 439/190–195, 439/745, 747, 587

[56] References Cited

U.S. PATENT DOCUMENTS

| | | | |
|---|---|---|---|
| 3,079,582 | 2/1963 | Lazar | 439/745 |
| 3,392,366 | 7/1968 | Nakazawa | 439/745 |
| 3,624,585 | 11/1971 | Kokalas et al. | 439/195 |
| 3,673,541 | 6/1972 | Volinskie | 439/195 |
| 4,652,064 | 3/1987 | Cetrone | 439/587 |
| 5,074,802 | 12/1991 | Gratziani et al. | 439/192 |
| 5,344,341 | 9/1994 | Yoshino | 439/607 |
| 5,405,269 | 4/1995 | Stupecky | 439/191 |

FOREIGN PATENT DOCUMENTS

| | | | |
|---|---|---|---|
| 0197818 | 10/1986 | European Pat. Off. . | |
| 2529990 | 1/1984 | France | 439/192 |
| 3247091 | 11/1983 | Germany . | |
| 4310616 | 10/1993 | Germany . | |

OTHER PUBLICATIONS

IBM Technical Disclosure Bulletin, "Fluidic Connector", by Welnicki, vol. 14, No. 10, p. 2916. Mar. 1972.

*Primary Examiner*—Gary F. Paumen
*Attorney, Agent, or Firm*—Browdy and Neimark

[57] ABSTRACT

An electrofluidic mixed connector in the form of a conventional electric connector in which at least one of the connection members of the socket type connection element is replaced by a first fluidic connection coupling, while the corresponding connection member of the second connection element is replaced by a second fluidic connection coupling, one of the couplings being of the pin type and the other being of the socket type, and the pin type coupling being designed so as to be able to fit tightly into the socket type coupling at the same time as the electric pin connection members fit into the socket connection members. This connector applies notably to the connecting of electropneumatic devices.

8 Claims, 3 Drawing Sheets

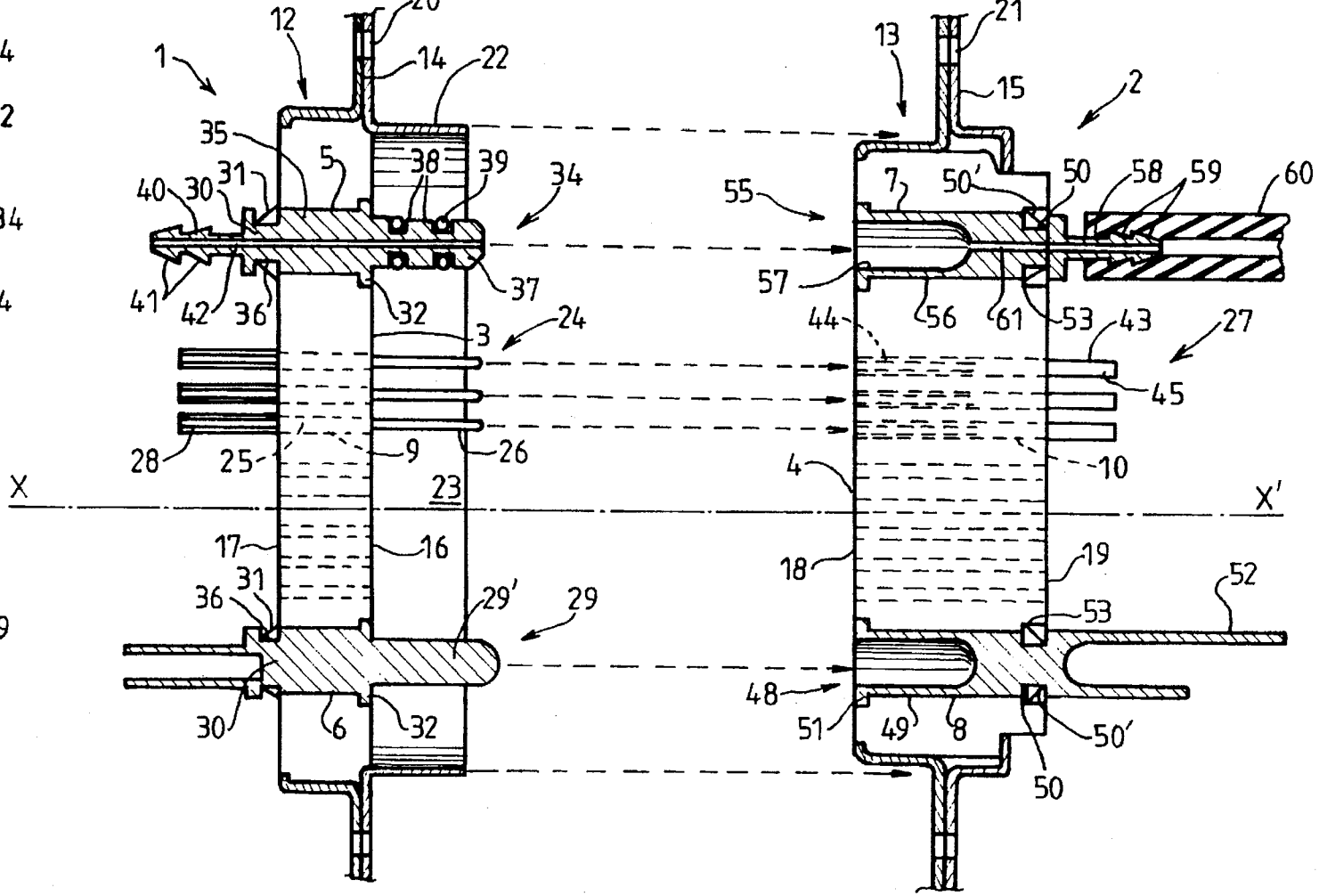
FIG.2
FIG.1
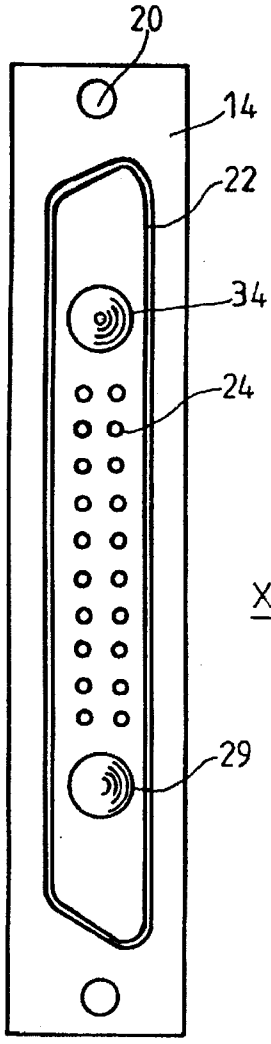
FIG.3

ELECTROFLUIDIC MIXED CONNECTOR

BACKGROUND OF THE INVENTION

1. Field of the Invention

This invention relates to an electrofluidic mixed connector (electropneumatic or electrohydraulic).

2. Description of the Prior Art

Generally, it is known that in equipment or installations combining together electrical, electronic, pneumatic and/or hydraulic circuits, connection problems are dealt with separately and the connectors used are specific to one or other of these circuit types. These connectors are usually standardized.

This solution obviously entails numerous drawbacks especially in terms of cost, space requirements and adaptation as a function of possible applications, since each connector must have its own structure, securing means, polarizing means, etc.

Moreover, for the user, this solution requires the availability of different ranges of connectors for each of the circuit types in question, and thus considerable stocks of components.

With a view to solving problems specific to certain applications, it has been proposed electrical connection members associated with pneumatic connectors.

However, the structure of the connectors thus obtained has proved to be relatively complex and costly and remains closely linked to the application for which it was designed.

For these different reasons and, in particular, this failure to be multi-purpose, these connectors have not been developed on a large scale.

OBJECT OF THE INVENTION

The main object of this invention is to remedy the preceding disadvantages, particularly to enable the user of standard connectors to indifferently mount, without any special tooling, electrical and/or fluidic electrical connection member as a function of the application envisaged.

SUMMARY OF THE INVENTION

Accordingly, there is provided an electrofluidic mixed connector having the structure of a standard conventional electrical connector for multi-purpose use of the type comprising two connection elements susceptible of coupling with one another and each comprising a part in insulating material having two sides parallel and a plurality of passages perpendicular to said sides, each of these passages receiving a pin or socket type connection member in such a way that, at the time of coupling, the pin members of one of the two insulating parts can fit into the socket members of the other part and vice versa, at least one of the passages receiving indifferently an electrical or electrofluidic connection member, these two connection members having an outer conformation at the level of their engagement into the insulating parts and each comprising an autonomous securing means engaging with corresponding conformations of the insulating part to ensure axial locking in both directions of said connection member in its passage, the fluidic connection member consisting of a tubular pin or socket coupling, the pin coupling having a cylindrical front portion susceptible of fitting into a coaxial bore provided in the front part of the socket coupling, said front portion supporting an annular sealing means intended to fit into the bore of the socket coupling in order to ensure tightness between the two couplings in the coupled position.

By way of these arrangements, the connector embodying the invention has numerous advantages.

It is inexpensive due to the fact that it can be manufactured with geometrically simple parts (i.e. the cost of standard connectors already manufactured in large quantities).

Its space requirements are small since the mechanical structure is common to both the electrical and fluidic functions.

The sealing means between the pin and socket couplings is provided on the pin couplings. It is therefore accessible from the outside of the equipment and lends itself to easy mounting.

Production of these connectors is simplified as they do not entail any specific mounting related to the pneumatic function and due to the fact that the fluidic connection members can be interchanged with the electrical connection members.

The end user of connectors of this type can configure himself a standard electrical connector either as an electrical connector or as an electrofluidic connector. This operation is very simple to perform and does not require any specialized tooling. To do so, it is merely needed to insert, into the passages provided to this end, the electrical or fluidic connection members required for use. This operation involves a minimum number of parts, i.e. only the connection members inserted into the passages in the insulating parts, by way of the fact that the electrical or fluidic connection members embodying the invention are fully autonomous in that they bear their own means for securing themselves into the standard electrical connector, and the fluidic elements comprise their own tightness means.

Advantageously, the means for securing the connection members into the insulating parts comprises an axial stop means in one direction and an annular groove fitted with an elastic means allowing sliding in said direction and ensuring an axial locking in the other direction.

Furthermore, it has been observed that the strains exerted during the coupling of the two connection elements are greater than during the uncoupling thereof. In order to take this observation into account, said stop means is provided to ensure the locking of the connection member in the insulating part in the direction of coupling, said elastic means being provided in the rear part of said connection members.

However, this solution meets with considerable difficulties in the case of connectors with pin and socket type insulating parts of same thinness, and in the case of a relatively long length of the pin members being required to fit into the socket members with a view to achieving better tightness or better electrical contact. In fact, the socket couplings are not thick enough for an annular groove to be made, as the entire portion fitted into the insulating part is occupied by the bore intended to receive the front part of the pin member. Furthermore, in the case of fluidic connection members, it is not possible, for tightness reasons, to position axial stop means acting in the direction of coupling at the level of the passage opening, while inserting the member into the insulating part via the rear side of the latter.

To obviate this problem, the elements embodying the invention are inserted into the insulating parts from the front side of each of the latter, said stop means being constituted by an annular flange bearing against said front side, said annular groove being provided in a rear part opposite said front part.

In this manner, the insulating parts can indifferently receive pin or socket connection members, thus enabling electrical, electrofluidic or completely fluidic connectors to be obtained, with polarizing means obtained by the coupling of the pin and socket members in each of the insulating parts.

Furthermore, the connection members are maintained in the passages of the insulating part over virtually the entire thickness of the latter, thus suppressing all radial looseness.

According to a feature of the invention, said securing means enables the connection members to be dismounted from the insulating parts without any special tooling. Thus, the user can configure a same standard connector several times over.

Advantageously, the two parts in insulating material can be respectively fitted into and fixed inside two tubular supporting structures that can fit snugly into one another to ensure guidance of the connection members and/or couplings during connection.

In this case, the two tubular structures can be equipped with securing and/or polarizing means.

BRIEF DESCRIPTION OF THE DRAWINGS

Further features and advantages of the invention will be apparent from embodiments of the invention described, by way of non-limiting examples, in reference to the corresponding accompanying drawings in which:

FIGS. 1 and 2 are two schematic axial sections of a pin connection element and a socket connection element of a plug-in board connector of conventional structure;

FIG. 3 is a front view of the front side of the socket connection element;

DESCRIPTION OF THE PREFERRED EMBODIMENTS

Figure 4:
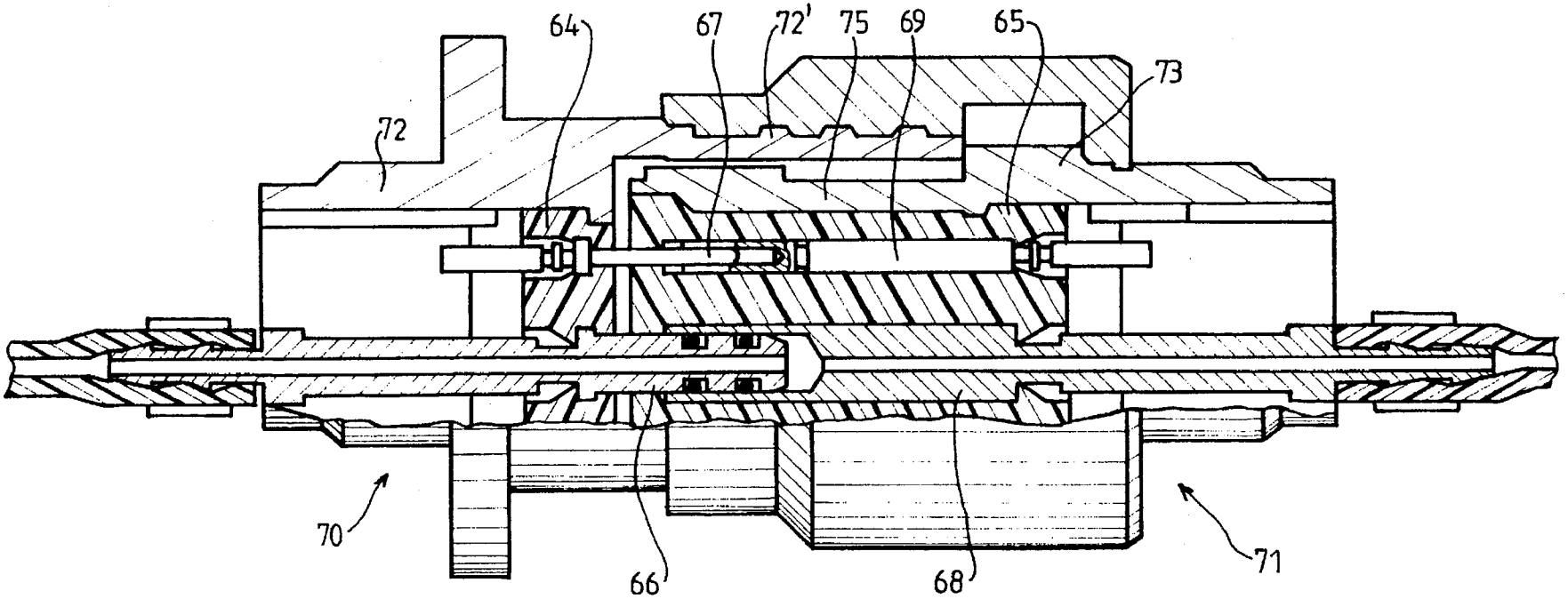
FIG. 4 is an axial section of another embodiment of a connector according to the invention, in the assembled position.

As represented in FIGS. 1 to 3, the connector is comprised of two connection elements 1, 2 respectively of the pin and socket types each comprising:

- an electrically insulating seat 3, 4 of flat, elongated and substantially trapezoidal shape, passed through by a multiplicity of passages, i.e. two passages of relatively large diameter 5, 6, 7, 8 respectively disposed at the two ends of the seat, and, between these two passages 5, 6, 7, 8, two rows of passages of smaller diameter substantially parallel to the longitudinal axis X, X' of the connector,
- a tubular supporting structure or hoop 12, 13 of concave profile enclosing the seat 3, 4 by surrounding its entire periphery, this tubular structure 12, 13 having a rim 14, 15 extending to protrude outwardly parallel to the two main sides 16, 17–18, 19 of the seat 3, 4, said rim 14, 15 comprising, at the level of its two opposite ends, two respective passages 20, 21 for the purpose of securing the connection element 1, 2 to a supporting structure such as e.g. an electronic circuit board.

The pin type connection element 1, whose seat 3 is thinner than that of the socket element 2, further comprises an annular flange 22 which axially prolongs the hoop 12 while delimiting, on one side of the latter, a coupling cavity 23 of trapezoidal cross-section in which the hoop 13 of the socket element 2 can partially nest itself.

In the passages of small diameter 9 of the seat 3 are fitted and secured conventional type pin connection members comprising a central portion 25 substantially of the diameter of the passage 9 in which it is housed, and, on either side of this central portion:

- a full portion 26 which extends axially into the coupling cavity 23 and which is intended to fit into a socket member 27 of the connection element 2,
- a tubular portion 28 which protrudes outwardly from the rear side 17 of the seat 3 and on which can be soldered an electrical conductor.

In the passages of larger diameter 5, 6 are respectively fitted, via the front sides of the seats 3, 4, pin connection members 29, 34, respectively electrical and fluidic, each having a structure similar to that of the previous ones, the electrical connection member being intended to ensure an electrical connection withstanding a relatively high output. These connection members could of course be replaced, depending on applications, by coaxial or even triaxial electrical connection members, or by fluidic connection members compatible with the housing.

In this example, each of these connection members 29, 34 comprises, on the front side of the part fitted into the passage 5, 6, an axial stop means that can consist of a flange 32 which is embedded into a bore of complementary shape formed in the edges of the front opening of the passage. The rear part 30 of these connection members 29, 34 is provided with an annular groove 36 housing a means for securing the connection member into the seat 3, 4, this means consisting of an elastic conical washer 31, possibly open-worked, which bears against the rear side 17 of the seat 3 or against an annular shoulder formed in the passage 5, 6.

In the passage 5, of diameter identical to that of the passage 6, is disposed a fluidic (e.g. pneumatic) connection coupling 34 of general shape and space requirements similar to those of the connection member 29.

In a similar manner, this coupling 34 comprises a cylindrical central part 35, of same diameter as the passage 5, which is provided with an annular groove 36 intended to receive the washer 31 securing the coupling 34 into its passage.

The front portion 37 of the coupling 34 is of cylindrical shape of smaller diameter than that of the central part 35. However, in this instance the front part has two coaxial annular grooves 38 that are axially offset and are respectively intended to receive two O-ring tightness seals 39.

The rear portion 40 of the coupling 34, of smaller diameter than the previous ones, has annular ribs 41 in order to constitute a tight connection piece for flexible conduits.

The coupling 34 is, of course, run through by an axial channel 42 serving to convey a fluid such as compressed or even low-pressure air (vacuum).

It should be noted that, given their shape and dimensions, the connection members 29 and the couplings 34 can be disposed in one or other passage 5, 6 as required by the user, without this requiring any adapting whatsoever of the connector element or any assembly tool.

By comparison with the pin connection element 1, the socket connection element 2 has a thicker seat 4 and a hoop 13 which is extended on a front side of the rim 15, over a distance substantially equal to the width of the annular flange 26. At the level of this extension, the hoop 13 has a trapezoidal section of dimensions substantially smaller than those of the flange into which it is intended to fit.

The passages 7, 8, 10 in the seat 4 of this element are of the same diameter as those of the pin-type element and are spread out in the same way.

In this instance, the passages of small diameter 10 receive socket type electrical connection members 43 having two parts, i.e.

a first tubular portion 44 of inside diameter corresponding (to within the tolerances) to the outer diameter of the portions 26 of pins 24 and which is fully housed within the passage 10; these tubular portions 44 open out onto the outside at the level of the front side 18 of the seat 4, a partially tubular second portion 45 protruding from the rear side 19 of the seat 4; this portion 45 is designed so as to facilitate the soldering of an electrical conductor.

In the passage of larger diameter 8 is fitted, from the front side of the seat 4, an electrical socket connection member 48 of which a partially tubular first portion 49 has, on one side, an outer surface divided into four elements forming an elastic clip by way of four axial slots.

This conventional arrangement ensures the quality of the electrical contact obtained by fitting the cylindrical portion 29' of the pin member 29 into the cavity of the tubular portion 49 of the socket member 48.

This portion 49 comprises an axial stop means that can consist of a flange 51 that embeds itself into a passage of complementary shape formed in the edges of the front opening of the passage 8.

Furthermore, the portion 49 comprises, behind the connection zone, a coaxial annular groove 50 serving to enclose the means securing the connection member to the seat 4. This securing means can consist e.g. of elastic washers or clips 50' (FIG. 2) which bear against an annular shoulder 53 to ensure axial locking of the connection member 48 inside the passage 8. This shoulder is obtained by boring out a limited portion of the passage 7, 8, thereby avoiding the occurrence of radial looseness in the maintaining of the connection members within the passages.

From the annular groove 50 of the connection member 48 protrudes a tubular portion 52 onto which an electrical conductor can be soldered.

In the passage 7, of diameter identical to that of the passage 8, is disposed a socket type pneumatic connection coupling 55 of shape and outside dimensions similar to those of the socket connection member 48.

In a similar manner, this coupling 55 comprises a tubular portion 56, housed in the passage 7 of the seat 4 and comprising a cylindrical passage 57 of substantially the same outside diameter as the front part 37 of the coupling 34 it is intended to receive. The difference in diameter between the portion 56 and the groove 38 ensures compression of the O-ring seals 39. The bore 57 opens out at the level of the front side 18 of the seat 4. As with the electrical connection member 48, the rear part of this tubular portion 56 is provided with an annular groove 50 serving to enclose an elastic securing washer 50'.

The rear part 58 of the element 55, which protrudes from the rear side 19 of the seat 4, comprises annular ribs 59 and constitutes a tight connection piece for flexible conduits 60.

Here too, the connection coupling 55 is run through by an axial channel 61 serving to convey the compressed air (or the vacuum).

As previously, in view of the shape and dimensions thereof, the socket connection members and couplings 48, 55 can be disposed in one or other passage 7, 8 as required by the user, without this requiring any adapting whatsoever of the connector element or any special tool for assembly thereof.

By means of the two connection elements 1, 2 previously described, the electrical and pneumatic connections are achieved simultaneously by fitting these two elements 1, 2 into one another at the end of an axial translation of one of the elements in relation to the other.

The connection elements, irrespective of whether they are electrical or fluidic, are inserted into the seats 3, 4 by their front sides 16, 18 due to the fact that the strains brought to bear on these elements during coupling of the two connection elements 1, 2 are greater than during uncoupling thereof. In fact, during coupling, centering forces are exerted by the pin members into the socket members and are added to the frictional forces between them. It is for this reason that axial stop flanges 32, 51 have been provided on the front part of the connection members, in addition to a lighter securing means, i.e. elastic conical washers 31, 50' housed in an annular groove 36, 50 on the rear part of these connection members.

The connection members 29, 34, 48, 55 are simply secured by inserting them into the passages, the elastic washer 31, 50' spreading itself out at the exit of the passages 5 to 8.

The invention is not, of course, limited to the embodiment described above.

Thus, for instance, the number of passages of large diameter 5, 6–7, 8 could be greater than two, these passages being capable of receiving a number of electrical connection members 29, 48 or of pneumatic connection couplings 34, 55 to suit users' requirements. The passages of smaller diameter 9, 10 and the corresponding connection devices 24, 27 could be suppressed, if required.

In the example previously described, the polarizing means is comprised of the trapezoidal shapes of the hoop parts 12, 13 fitting into one another. It is obvious that this polarizing means could be different without modifying the object of the invention.

For instance, the connector could be of a structure such as the one illustrated in FIG. 4.

In this example, the seats 64, 65 in which are mounted the connection members 66, 67, 68, 69 of the pin and socket connection elements 70, 71, and the tubular structures in which these seats 64 are supported, are of circular shape.

More precisely, the pin connection element 70 comprises a circular-shaped seat 64 fixed into a cylindrical bushing 72 of which the part delimiting the coupling volume has a thread 72'.

This seat 64 comprises a plurality of passages of small diameter evenly spaced over a circle that is concentric with the seat, and two passages of larger diameter slightly off out line in relation to the longitudinal axis of the element 70. The passages of small diameter are used to secure pin type electrical connection members 67 similar to the ones previously described, whereas the passages of larger diameter serve indifferently for mounting electrical connection members for relatively high outputs (or even coaxial or triaxial members) or of pneumatic connection couplings.

In the example represented, the passage of larger diameter is assigned to a pin connection coupling 66 similar to the coupling 34 previously described.

Likewise, the socket connection element 71 comprises a cylindrical-shaped seat 65 which is in turn secured to a cylindrical bushing 73 of which the front part 75 is of a diameter slightly smaller than the inside diameter of the front part of the bushing into which it fits.

Around this bushing 73 is mounted coaxially rotating though axially maintained on the latter, a nut capable of screwing onto the threaded outer surface of the bushing.

Like the seat 64, the seat 65 comprises a multiplicity of passages of small diameter inside which are secured socket type electrical connection members 69 intended to receive the pin type connection members 67 of the connection element 70.

The passages of larger diameter can receive either electrical connection members or pneumatic connection couplings 68 such as the one represented and whose structure is similar to that of the coupling 48 previously described.

It is clear that the solution provided by the invention is very easy to industrialize. In fact, it uses a standard electrical connector structure on which one or more electrical connection members are simply replaced by one or more pneumatic connection couplings fitted in a rigourously identical manner. Production of this coupling does not involve any difficulty and implements the same techniques as those of the electrical elements, e.g. slicing.

Figure 5:
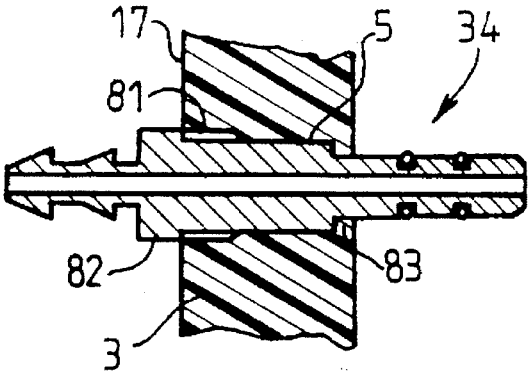
FIGS. 5 and 6 show an axial section of an embodiment of the means of securing the pin and socket members in the passages in the insulating parts of the connector.
Figure 6:
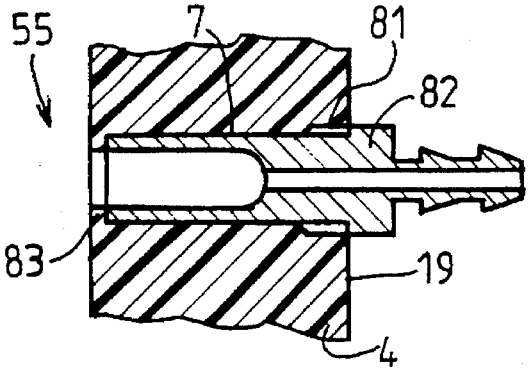

According to the embodiment in FIGS. 5 and 6, the means for securing the connection members 34, 55 comprises, in the passages 5, 7, a tapped portion 81 which cooperates with a threading formed on a portion of the connection members. These connection members are screwed into the passages 5, 7 by means of a conventional screwing tool which cooperates with a portion 82 of complementary shape, e.g. having a hexagonal cross section, situated in the rear part of the connection members.

In this example, the connection members are inserted into the passages 5, 7 from the rear side 17, 19 of the seats 3, 4 and are brought to bear against an axial stop 83 situated at the level of the front opening of the passages 5, 7.

Only the fluidic connection members 34, 55 have been represented in these figures. It goes without saying that electrical connection members have identical shape and outer dimensions to those of the fluidic elements.

By way of these arrangements, the user can use a conventional tightening tool to modify the configuration of the connector, by replacing electrical connection members by fluidic connection members and vice versa.

Figure 7:
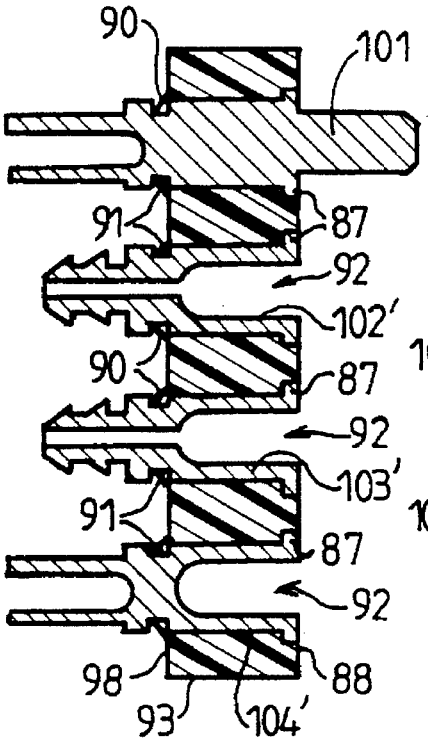
FIGS. 7 and 8 show an axial section of an embodiment of a pin connection element and a socket connection element of a connector.
Figure 8:
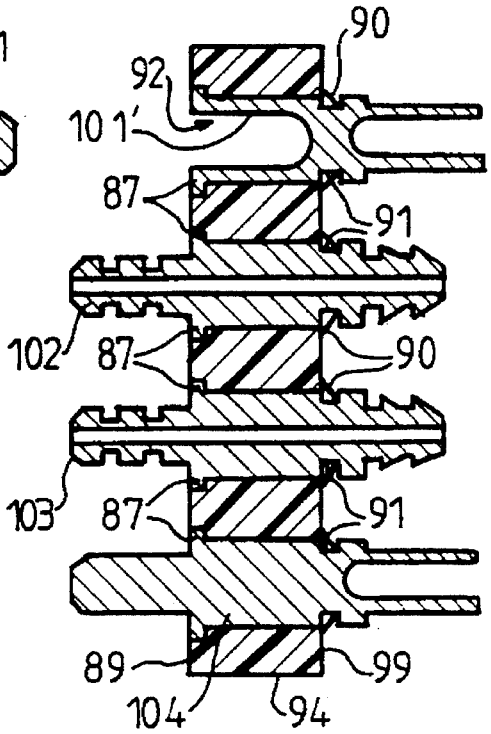

In FIGS. 7 and 8, the connector comprises two seats 93, 94 in electrically insulating material, having identical minimum thicknesses, each being provided with four cylindrical passages in which are housed electrical 101, 104, 101', 104' and fluidic 102, 103, 102', 103' connection members, the members of the first seat 93 being intended to simultaneously fit into the connection members of the second seat 94.

The passages 92 in the socket members 101' to 104' extend substantially through the entire thickness of the seats 93, 94.

Each of these connection members comprises, at the level of its front part, a radial flange 87 acting as an axial stop which embeds itself into a bore provided in the front side 88, 89 of the seats 93, 94, these connection members being removable and mounted on the seats from this front side.

Furthermore, each of these connection members comprises, at the level of its rear part, an annular groove housing an elastic means such as an elastic conical washer capable of sliding into the passage in the direction of insertion of the connection member into the seat and of the coupling, and which spreads itself out to lock itself against the rear side 98, 99 of the seats 93, 94, thus ensuring axial locking of the connection member in its passage in the uncoupling direction.

It should be noted that the elastic washers 90 are situated outside the passages. By means of an appropriate tool the user can thus enter these washers into the passages in order to dismount the connection members 101 to 104, 101' to 104' from the seats 93, 94.

It should also be noted that all the passages in the seats are of identical shape and dimensions, as are the outer contours of the portions of the connection members housed in these passages. Consequently, it is easy for users of this connector to modify the relation between the number of fluidic elements 102, 102', 103, 103' and electrical elements 101, 101', 104, 104' and the distribution of the latter, as well as to permute the pin connection members 101 to 104 and the socket connection members 101' to 104', between the two seats 93, 94, thereby offering a large number of possible combinations. A polarizing means defined by the distribution of the pin and socket connection members between the two seats 93, 94 is thus obtained in a simple manner.

I claim:

1. An electrofluidic mixed connector, having a shape and structure of a standard conventional electrical connector for multi-purpose use, said connector comprising two connection elements susceptible of removably coupling with one another, said two connection elements comprising two respective bases of insulating material having a same thickness, each of said two bases having two parallel faces and a plurality of passages therethrough which are perpendicular to said parallel faces, said passages receiving indifferently a respective pin or socket type connection member, said passages and the connection members disposed therein being arranged so that, in a coupled position of said connection elements, the pin type connection members are fitted into the socket type connection members, at least two respective corresponding passages of said two insulating bases being designed to receive indifferently respectively a pin and socket type electrical or electrofluidic connection members, each of the pin and socket type connection members having a middle portion fitted into the insulating base, said middle portion having an outer conformation and an autonomous securing means which engage with corresponding conformations provided in said insulating base so as to ensure releasable axial locking in both directions of said connection member in its passage, said electrofluidic connection members comprising respectively a tubular pin coupling and a tubular socket coupling, said pin coupling having a cylindrical front portion for fitting into a coaxial bore provided in a front part of said socket coupling, said front portion supporting an annular sealing means which engages in said bore of said socket coupling in order to ensure tightness between said pin and socket couplings in said coupled position of said two connection elements.

2. The connector as claimed in claim 1, wherein said securing means for securing the connection members into the insulating bases comprises an axial stop means in a first direction and an annular groove fitted with an elastic means allowing axial sliding in said first direction and ensuring a releasable axial locking in a second direction opposite to said first direction.

3. The connector as claimed in claim 2, wherein said axial stop means is provided in a front part of said connection members in order to ensure axial locking in the coupling direction of said connection elements, whereas said annular groove is provided in a rear part of said connection members.

4. The connector as claimed in claim 2, wherein said elastic means comprises an elastic conical washer having outer edges which bear against a rear side of said insulating bases.

5. The connector as claimed in claim 1, wherein the securing means enables dismounting of said connection members from said insulating bases.

6. The connector as claimed in claim 1, wherein the passages in said socket connection members extend substantially through the whole width of said insulating bases.

7. The connector as claimed in claim 1, wherein said two insulating bases are respectively fitted into and secured inside two tubular-shaped supporting structures that can fit snugly into one another to ensure guidance of the connection members during connection.

8. The connector as claimed in claim 1, wherein said pin type fluidic coupling is passed through by an axial channel and comprises a cylindrical central part having a substantially same diameter as the insulating base into which it fits, a front portion provided with at least an annular groove intended to receive an O-ring tightness seal, and a rear portion constituting a tight connection piece for a flexible conduit, and wherein said socket type fluidic coupling is passed through by an axial channel and comprises a tubular middle portion housed in the passage of said insulating base and provided with a cylindrical bore of diameter equal to that of the front portion of said pin type coupling, said bore opening out in a front side of said insulating base, said socket type fluidic coupling further comprising a rear part which protrudes from a rear side of said insulating base and which constitutes a tight connection piece for flexible conduits.

* * * * *